US008164035B2

(12) United States Patent
Chang

(10) Patent No.: US 8,164,035 B2
(45) Date of Patent: Apr. 24, 2012

(54) HEATING DEVICE HAVING DUAL-CORE HEATING CABLE

(76) Inventor: Long-Huang Chang, Banciao (TW)

( * ) Notice: Subject to any disclaimer, the term of this patent is extended or adjusted under 35 U.S.C. 154(b) by 1042 days.

(21) Appl. No.: 12/104,459

(22) Filed: Apr. 17, 2008

(65) Prior Publication Data

US 2009/0261089 A1 Oct. 22, 2009

(51) Int. Cl.
*H05B 3/34* (2006.01)

(52) U.S. Cl. ..... 219/549; 219/505

(58) Field of Classification Search ..... 219/490, 219/494, 505, 517, 541, 544, 546, 501, 212, 219/213, 481, 504, 548, 552, 549, 547, 667, 219/506, 528, 529, 388, 400, 435, 489, 516; 338/214, 208, 229, 257, 332, 274, 28, 22 R, 338/26; 392/480, 472, 301, 302, 303, 304, 392/305, 306, 435, 468, 409, 482
See application file for complete search history.

(56) References Cited

U.S. PATENT DOCUMENTS 6,064,044 A * 5/2000 Jerome ..... 219/501
6,770,853 B2 * 8/2004 Krieger et al. ..... 219/497
7,241,979 B2 * 7/2007 Kil ..... 219/505
* cited by examiner

*Primary Examiner* — Quang T Van
*Assistant Examiner* — Phuong Nguyen
(74) *Attorney, Agent, or Firm* — Leong C. Lei

(57) ABSTRACT

The heating device mainly contains a dual-core heat cable and a control circuit. The dual-core heating cable mainly contains a core, a heating wire winding spirally around the core, a NTC (negative-temperature-coefficient) layer wrapping around the core and the heating wire, a PTC heating wire winding spirally around the NTC layer, and an insulating layer wrapping around the NTC layer and the PTC heating wire. The control circuit monitors the PTC heating wire's current for constant temperature control, and the leakage current through The NTC layer as a second over-temperature protection. As such, the heating device has a superior constant temperature effect and avoids the problem of burning down the heating cable. The heating device therefore has a longer operational life span.

10 Claims, 10 Drawing Sheets

HEATING DEVICE HAVING DUAL-CORE HEATING CABLE

TECHNICAL FIELD OF THE INVENTION

The present invention generally relates to heating devices, and more particularly to a heating device using a dual-core heating cable as the heat source.

DESCRIPTION OF THE PRIOR ART

Republic of China, Taiwan, Patent Application Number 094101339 teaches a heating device which contains a heating cable and a controller. The heating cable is composed of a core, a positive-temperature-coefficient (PCT) element, an insulating fusible layer, and a short-circuit wire. The PCT element is connected to an end of the short-circuit wire. The controller is connected to the PCT element and the other end of the short-circuit wire. The controller also contains a circuit board which has an AC power phase shaping circuit and an AC power phase delay circuit.

The two circuits turn the input AC power's sinusoidal waveform into square waves. A microprocessor of the circuit board periodically monitors the phase difference between the square waves and then turns on and off an activation circuit accordingly. The activation circuit in turns controls the continuous heating or cooling of the PTC element so as to keep the heating cable at a specific temperature.

The insulating fusible layer is melted when the PCT element is getting too hot and the PCT element is thereby in contact with the short-circuit wire so as to provide over-temperature protection. However, once the insulating fusible layer is melted and the entire heating device can no longer function. Additionally, it is not uncommon that the heating cable is burned down after a period of usage. Therefore, the conventional heating device is less economical and has a limited operation life span.

SUMMARY OF THE INVENTION

The primary purpose of the present invention is to provide a novel heating device, which mainly contains a dual-core heat cable and a control circuit.

The dual-core heating cable mainly contains a core, a heating wire winding spirally around the core, a NTC (negative-temperature-coefficient) layer wrapping around the core and the heating wire, a PTC heating wire winding spirally around the NTC layer, and an insulating layer wrapping around the NTC layer and the PTC heating wire.

The control circuit monitors the PTC heating wire's current for constant temperature control, and the leakage current through The NTC layer as a second over-temperature protection. As such, the heating device has a superior constant temperature effect and avoids the problem of burning down the heating cable. The heating device therefore has a longer operational life span.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
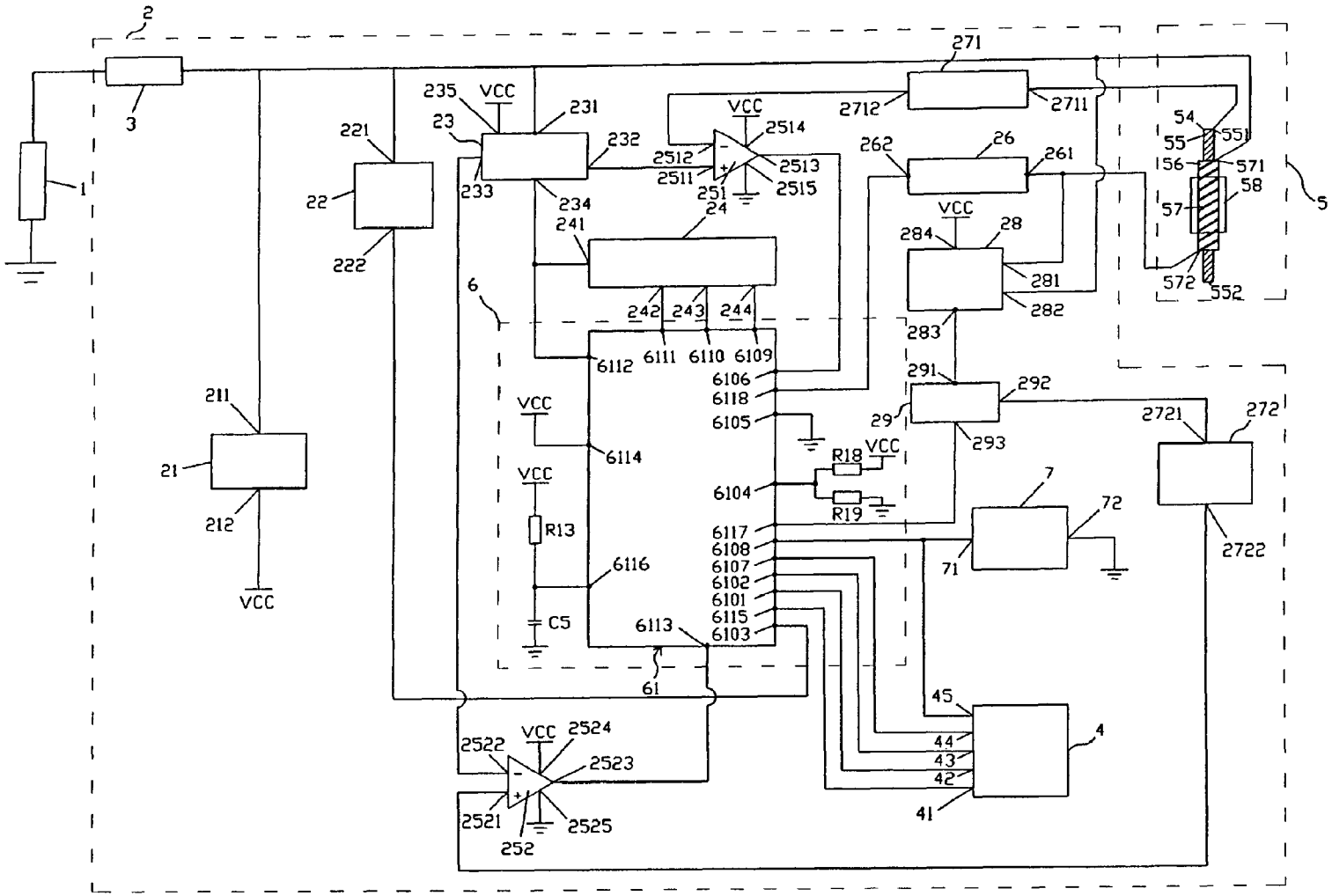
FIG. 1 is a functional block diagram showing a heating device according to the present invention.
Figure 2:
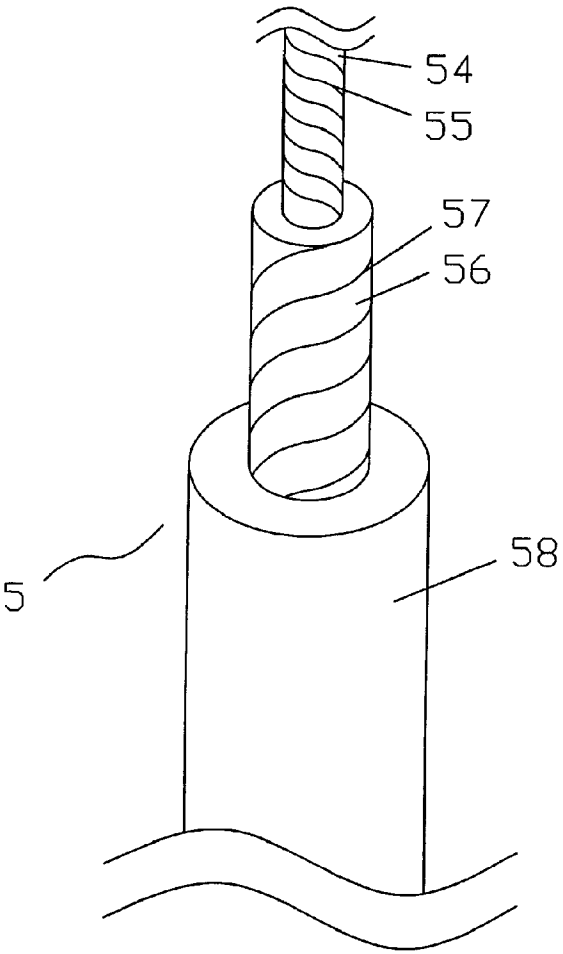
FIG. 2 is a perspective schematic diagram showing a first embodiment the heating cable of FIG. 1.
Figure 3:
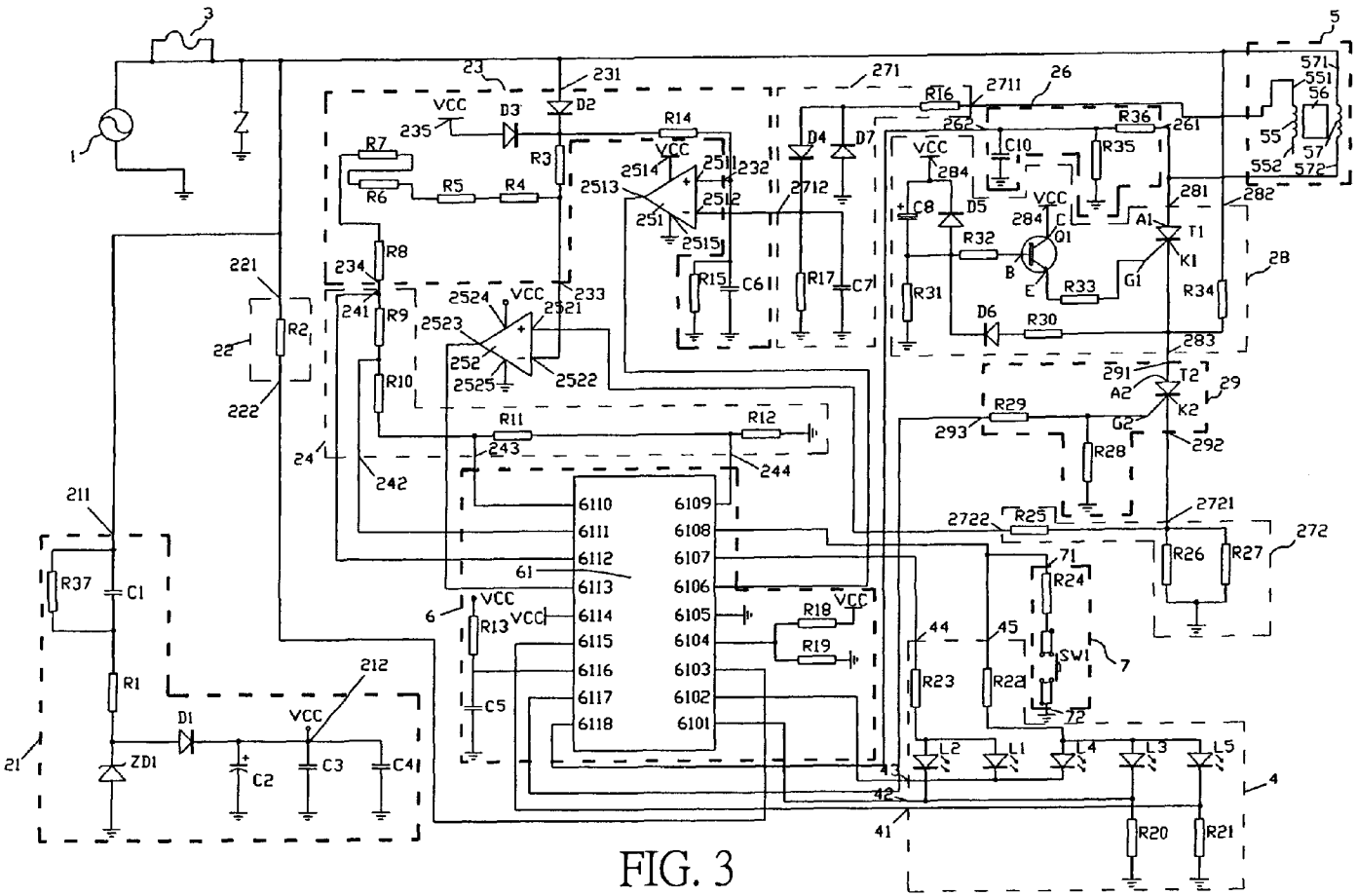
FIG. 3 is a circuit diagram showing a first embodiment of the heating device of FIG. 1.

As illustrated in FIGS. 1 to 3, a heating device according to an embodiment of the present invention mainly contains a heating cable 5 and a control circuit 2.

The heating cable 5 has a core 54 and the core 54 is wound spirally by a heating wire 55. The core 54 and the heating wire 55 are then clad in a NTC layer 56 which is also wound spirally by a PTC heating wire 57. The foregoing assembly is then clad altogether in an insulating layer 58. A first end 571 of the PTC heating wire 57 is connected to an AC power source 1 via a fuse 3 and a second terminal 282 of a protection circuit 28. On the other hand, a second end 572 of the PTC heating wire 57 is connected to a first terminal 261 of a load detection circuit 26 and a first terminal 281 of the protection circuit 28. In addition, a first terminal 2711 of a NTC detection circuit 271 is connected a first end 551, a second end 552, or both of the heating wire 55.

The control circuit 2 contains a DC voltage circuit 21 having a first terminal 211 connected to the AC power source 1 also via the fuse 3 of the control circuit 2. The DC voltage circuit 21 then produces a DC voltage Vcc at a second terminal 212 for driving some of elements of the control circuit 2.

The DC voltage circuit 21 contains capacitors C2, C3, and C4, parallel-connected together between the second terminal 212 and ground. The DC voltage circuit 21 further contains a capacitor C1, a resistor R1, and a Zener diode ZD1, series-connected in this order between the first terminal 211 and ground. An additional resistor R37 is parallel-connected to the capacitor C1 between the first terminal 211 and the resistor R1. A diode D1 has its cathode connected to the second terminal 212 and its anode to the cathode of the Zener diode ZD1 whose anode is connected to the ground.

The control circuit 2 also contains a controller circuit 6 mainly composed of a microcontroller 61 having terminals 6101 to 6118. The terminal 6114 is connected to the Vcc (i.e., the second terminal 212 of the DC voltage circuit 21). The terminal 6105 is connected to ground. The controller circuit 6 also contains resistors R18 and R19, series-connected in this order together between Vcc and ground. The terminal 6104 of the microcontroller 61 is connected to the junction between R18 and R19. The controller circuit 6 further contains a resistor R13 and a capacitor C5, series-connected in this order together between Vcc and ground. The terminal 6116 of the microcontroller 61 is connected to the junction between R13 and C5.

The control circuit 2 further contains a first comparator 251 and a second comparator 252, both having their power terminals 2514 and 2524 connected to Vcc, their ground terminals 2515 and 2525 connected to ground, and their output terminals 2513 and 2523 connected to the terminals 6106 and 6113 of the microcontroller 61, respectively.

The control circuit 2 has a synchronous signal input circuit 22, which is a resistor R2 in the present embodiment, whose first and second terminals 221 and 222 are connected to the AC power source 1 via the fuse 3 and the terminal 6103 of the microcontroller 61, respectively.

The control circuit 2 contains a reference voltage circuit 23 having a first terminal 231 connected to the AC power source 1 via the fuse 3, a second terminal 232 connected to a positive terminal 2511 of the first comparator 251, a third terminal 233 connected to a negative terminal 2522 of the second comparator 252, a fourth terminal 234 connected to a first terminal 241 of an adjustment circuit 24 (and the terminal 6112 of the microcontroller 61), and a power terminal 235 connected to the Vcc.

The reference voltage circuit 23 contains resistors R8, R7, R6, R5, R4, series-connected in this order between the terminals 234 and 233. The reference voltage circuit 23 also contains a diode D2 and a resistor R3, series-connected in this order between the terminals 231 and 233 (diode D2 has its anode connected to the terminal 231). A diode D3 has its anode connected to the power terminal 235 and its cathode connected to the junction between D2 and R3, which is in turn connected to the terminal 232 via a resistor R14. A resistor R15 and a capacitor C6 is parallel-connected between the terminal 232 and ground.

The adjustment circuit 24 has a first terminal 241 connected to the terminal 234 of the reference voltage circuit 23 and the terminal 6112 of the microcontroller 61. The adjustment circuit 24 further has a second terminal 242, a third terminal 243, and a fourth terminal 244 connected to the terminals 6111, 6110, and 6109 of the microcontroller 61, respectively. Inside the adjustment circuit 24, there are resistors R9, R10, R11, and R12, series-connected in this order between the terminal 241 and ground. The terminals 242, 243, and 244 are connected to the junctions between R9 and R10, R10 and R11, and R11 and R12, respectively.

The NTC detection circuit 271 is also part of the control circuit 2. The first terminal 2711 of the NTC detection circuit 271 is connected to the first end 551 of the heating wire 55 (or the second end 552, or both). A second terminal 2712 of the NTC detection circuit 271 is connected to a negative terminal 2512 of the first comparator 251. Inside the NTC detection circuit 271, a resistor R16 and a diode D7 are series-connected in this order between the terminal 2711 and ground (the diode D7 has its anode connected to the ground). A resistor R17 and a capacitor C7 are parallel-connected between the terminal 2712 and ground. The terminal 2712 is further connected the junction between R16 and D7 via another diode D4 (the cathode of the diode D4 is connected to the terminal 2712).

The control circuit 2 has a PTC detection circuit 272 whose second terminal 2722 is connected to a positive terminal 2521 of the second comparator 252 and whose first terminal 2721 is connected to a second terminal 292 of a switch circuit 29. Inside the PTC detection circuit 272, resistors R26 and R27 are parallel-connected between the terminal 2721 and ground. The terminal 2722 is then connected to the terminal 2721 via a resistor R25.

The switch circuit 29 has a third terminal 293 connected to the terminal 6117 of the microcontroller 61, and a first terminal connected to a third terminal 283 of the protection circuit 28. Inside the switch circuit 29, the terminals 291 and 292 are connected the anode A2 and cathode K2 of a thyristor T2, respectively. The gate G2 of the thyristor T2 is connected to the terminal 293 and the ground via resistors R29 and R28, respectively. In alternative embodiments, the thyristor T2 could be replaced by a triac.

The load detection circuit 26 of the control circuit 2 mentioned earlier has the first terminal 261 connected to the second end 572 of the PTC heating wire 57 and a second terminal 262 connected to the terminal 6118 of the microcontroller 61. The load detection circuit 26 contains a capacitor C10 and a resistor R35, parallel-connected together between the terminal 262 and ground. The terminal 262 is also connected to the terminal 261 via a resistor R36.

The protection circuit 28 of the control circuit 2, besides the terminals mentioned earlier, has a power terminal 284 connected to the Vcc. Inside the protection circuit 28, the terminal 281 is connected the anode A1 of a thyristor T1 whose cathode K1 is connected to the terminal 283. The gate G1 of the thyristor T1 is connected to the emitter E of a transistor Q1 via a resistor R33. The terminal 283 is also connected to the terminal 282 via a resistor R34. The power terminal 284 is, on one hand, connected to the collector C of the transistor Q1 and, on the other hand, connected to the cathode of a diode D5 and a terminal of a capacitor C8. The other terminal of the capacitor C8 and the anode of the diode D5 are connected to the base of the transistor Q1 via a resistor R32, and to the terminal 283 via a diode D6 and a resistor R30 series-connected in this order (the anode of the diode D6 is connected to the resistor R30), and to the ground via a resistor R31. In alternative embodiments, the thyristor T1 could be replaced by a triac.

The control circuit 2 has a function selection circuit 7 whose first terminal 71 is connected to the terminal 6108 of the microcontroller 61 and to a fifth terminal 45 of a status lamp circuit 4, and whose second terminal 72 is connected to the ground. The function selection circuit 7 contains a resistor R24 and a switch SW1 series-connected in this order between the terminals 71 and 72.

The status lamp circuit 4 of the control circuit 4 has a first terminal 41, a second terminal 42, a third terminal 43, and a fourth terminal 44 connected to the terminals 6115, 6101, 6102, and 6107, respectively. Inside the status lamp circuit 4, there are lighting elements (e.g., light emitting diodes) L1 to L5. Each lighting element L1 to L5 has a first terminal (e.g., the anode) and a second terminal (e.g., the cathode). The first terminals of the lighting elements L1 and L2 are connected the terminal 44 via a resistor R23. The first terminals of the lighting elements L3, L4, and L5 are connected to the terminal 45 via a resistor R22. The second terminals of the lighting element L1 and L4 are connected to the terminal 43. The second terminals of the lighting elements L2 and L3 are connected to the terminal 41 and to the ground via a resistor R20. The second terminal of the lighting element L5 is connected the terminal 41 and to the ground via a resistor R21.

The DC voltage circuit 21 is operated as follows. An AC voltage received from the AC power source 1 via the fuse 3 is rectified by the capacitor C1, stabilized by the Zener diode ZD1, filtered by the diode D1 and the capacitor C2, and the DC voltage Vcc is thereby produced.

Figure 4:
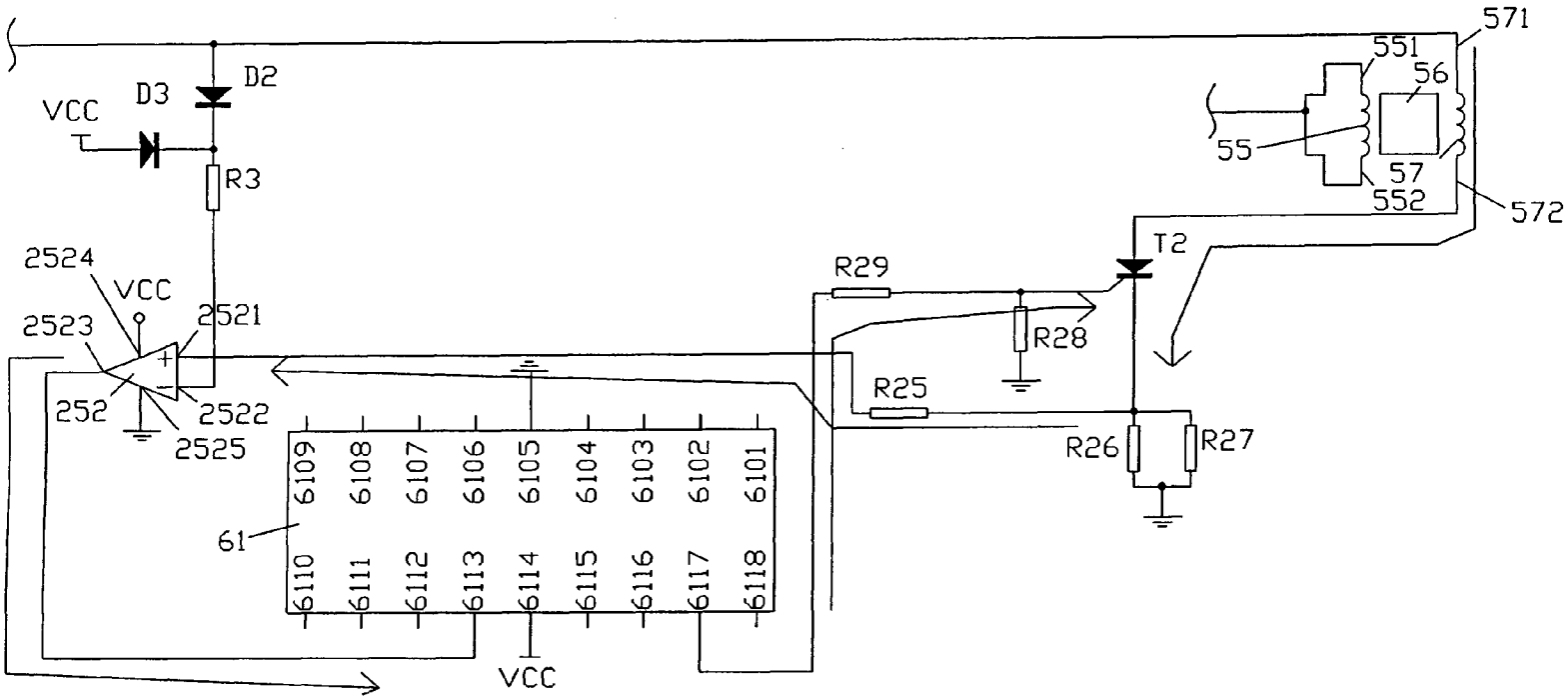
FIG. 4 is a partial circuit diagram showing the operation of the control circuit of FIG. 3 in PTC detection.

As shown in FIG. 4, when the microcontroller 61 is powered by the Vcc, a pulse is produced at the terminal 6117. The pulse, after being limited by the resistor R29, triggers the gate G2 of the thyristor T2. The anode A2 and the cathode K2 of the thyristor T2 are thereby conducted and the AC power is delivered to the PTC heating wire 57 of the heating cable 5. In the mean time, the PTC detection circuit 272 samples the load current of the PTC heating wire 57 by turning it to a sampled voltage by the resistors R26 and R27. The sampled voltage is then fed to the positive terminal 2521 of the second comparator 252. A reference voltage from the third terminal 233 is fed to the negative terminal 2522 of the second comparator 252. When the heating cable 5 has not yet reached a set temperature, the voltage at the positive terminal 2521 would be higher than that at the negative terminal 2522 of the second comparator 252. Therefore, a high voltage is produced at the output terminal 2523 of the second comparator 252 and at the terminal 6113 of the microcontroller 61. This would cause the microcontroller 61 to continuously produce pulses at the terminal 6117 so as to heat up the heating cable 5. Due to the PTC heating wire 57's characteristic (i.e., its resistance increases as its temperature rises), the sampled voltage by the resistors R26 and R27 would decrease. As the sampled voltage at the positive terminal 2521 is lower than the reference voltage at the negative terminal 2522 of the second comparator 252, a low voltage is produced at the output terminal 2523 and the terminal 6113 of the microcontroller 61, which would stop producing pulses at the terminal 6117. The thyristor T2 is therefore turned off and the heating cable 5 would cease to heat up. According to the foregoing description, when the temperature of the heating cable drops below the set temperature, the thyristor T2 would be turned on and the heating cable would be heated up again. As the process repeats as described, the heating cable 5 is maintained the set temperature.

As shown in FIG. 3, when the switch SW1 of the switch circuit 7 is set by a user to a temperature level, the terminal 6108 of the microcontroller 61 detects such a signal, the microcontroller 61 turns on corresponding lighting elements and, in the mean time, varies the voltages at the terminals 6109, 6110, 6111, and 6112. Then, through the combination of the resistors R4, R5, R8, R9, R10, R11, and R12, a different reference voltage is produced at the negative terminal 2522 of the second comparator 252. The heating cable 5 therefore would be heated up a different temperature.

Figure 5:
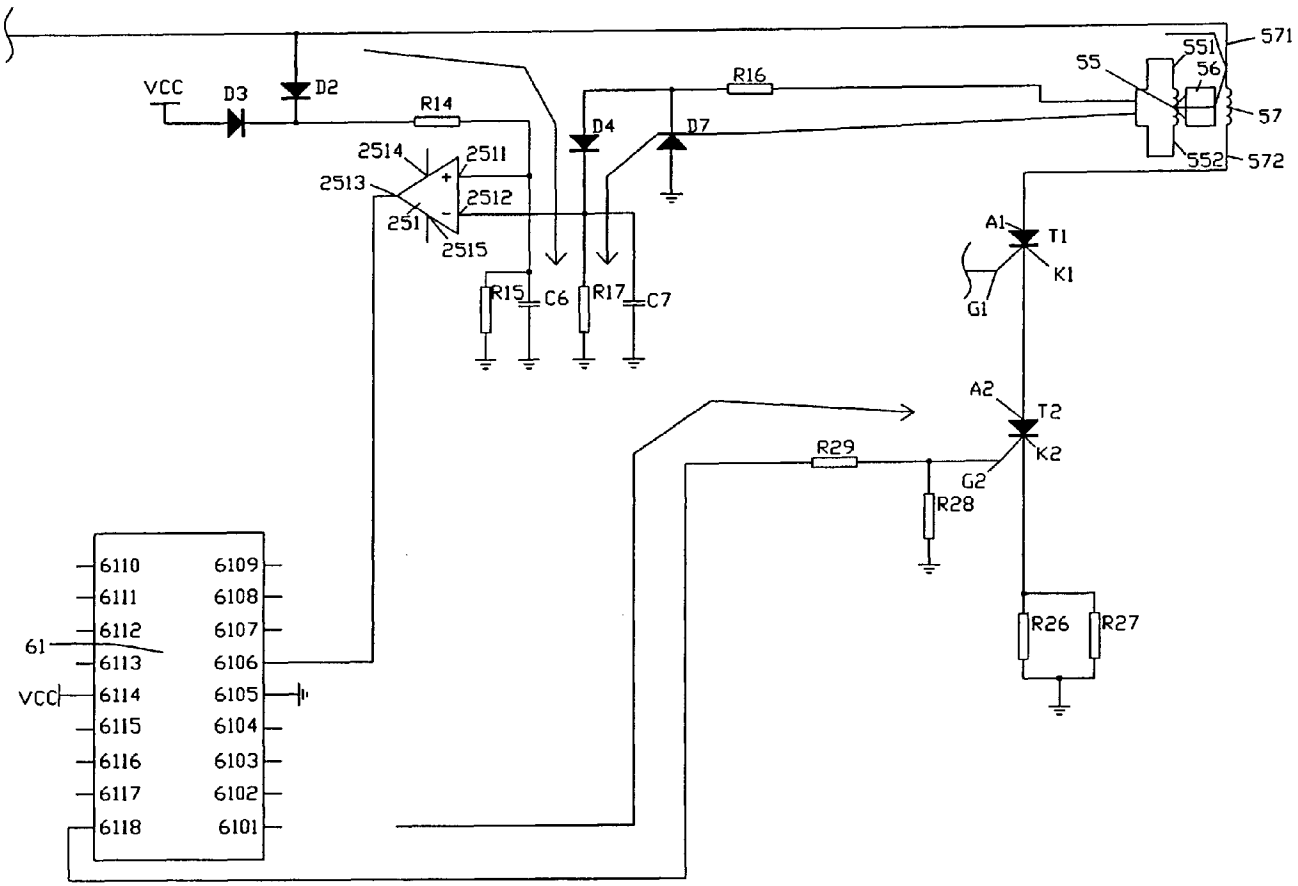
FIG. 5 is a partial circuit diagram showing the operation of the control circuit of FIG. 3 in NTC detection.

As shown in FIG. 5, when current is conducted through the PTC heating wire 57, some leakage current, through the NTC layer 56 of the heating cable 5, flows out of the first end 551 of the heating wire 55 into the NTC detection circuit 271. The leakage current is turned into a sampled voltage as it flows through the resistor R16, the diode D4, and the resistor R17. The sampled voltage is then fed to the negative terminal 2512 of the first comparator 251. A reference voltage is provided at the positive terminal 2511 of the first comparator 251 from the second terminal 232 of the reference voltage circuit 23. As such, when the heating device functions normally, a smaller leakage current would be produced due to the NTC layer 56 (i.e., its resistance decreases as its temperature increases). Therefore, the sampled voltage at the negative terminal 2512 is smaller than the reference voltage at the positive terminal of the first comparator 251, which produces a high voltage at its output terminal 2513 and at the terminal 6106 of the microcontroller 61. This would trigger the microcontroller 61 to produce a pulse at the terminal 6117 to keep heating up the heating cable 5. On the other hand, if the heating cable 5 has its overall or regional temperature too high, the NTC layer 56 would have a lower resistance, thereby contributing a larger leakage current. The sampled voltage would be higher than the reference voltage and the first comparator 251 would produce a low voltage to the terminal 6106 of the microcontroller 61. The microcontroller 61 therefore would stop producing pulses at the terminal 6117 and the heating cable 5 would stop heating up. This in effect provides a second over-temperature protection to the heating device. As the temperature of the heating cable 5 drops below a set temperature, the NTC layer 56 would have a higher resistance, the leakage current would be smaller, and the heating cable 5 would be heated up again.

Figure 6:
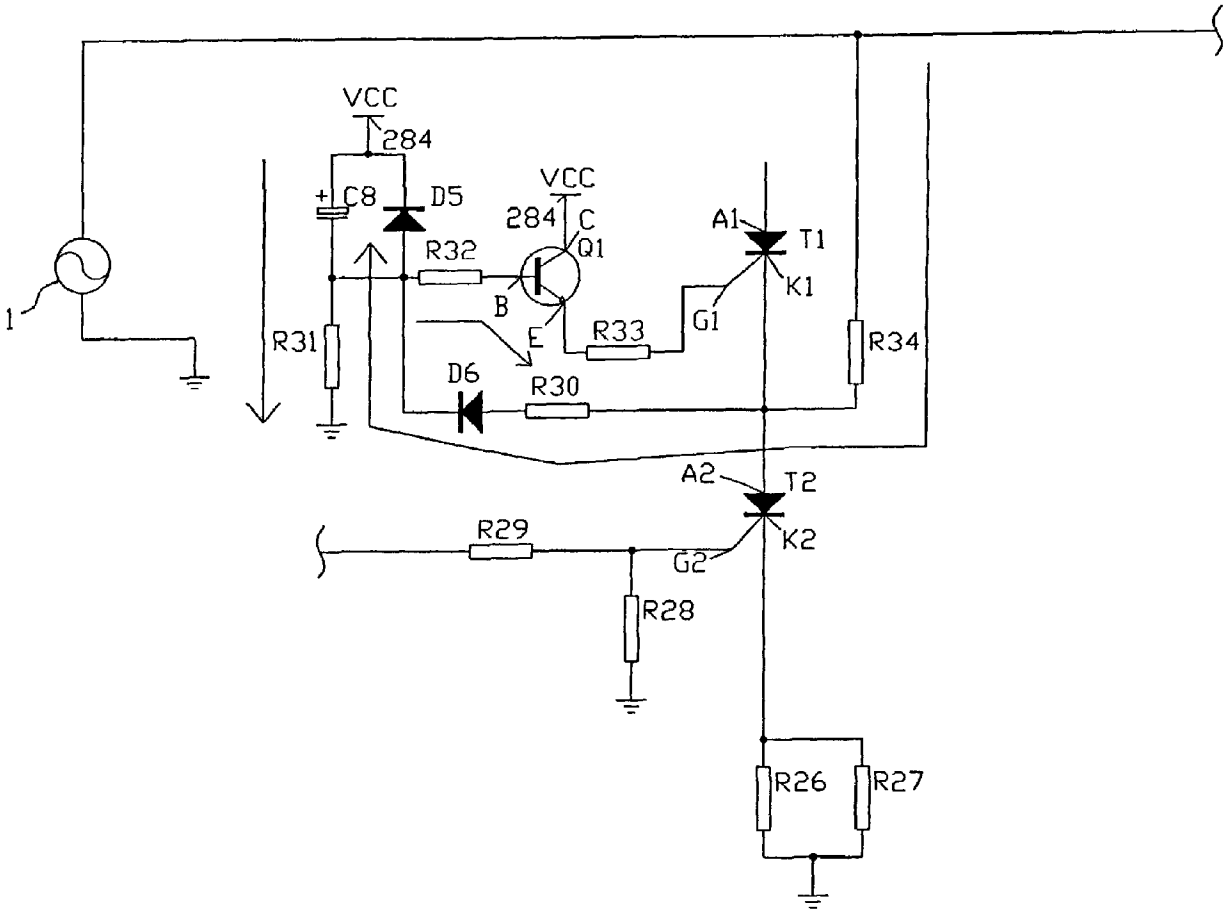
FIG. 6 is a partial circuit diagram showing the operation of the protection circuit of FIG. 3.

As shown in FIG. 6, when the control circuit 6 functions normally and the thyristor T2 is conducted, the capacitor C8 of the protection circuit C8 is forward-charged by the Vcc. When the thyristor T2 is turned off, the capacitor C8 is reverse-charged by the AC power source 1 via the resistors R34 and R30, and the diodes D6 and D5. As the capacitor C8 is repeatedly charged as described, the transistor Q1 is triggered and in turn the thyristor T1 is conducted. The heating cable 5 therefore functions normally. If the control circuit 6 malfunctions so that the heating cable 5 continuously heats up and the capacitor C8 is forward-charged for about 30 seconds, the voltage at the base B of the transistor Q1 would be lower than 0.7V, thereby turning off the transistor Q1 and causing the heating cable 5 to stop heating up.

As a brief summary, the heating device monitors the PTC heating wire 57's current for temperature control. The NTC layer 56 on the other hand provides a second over-temperature protection. As such, the heating device has a superior constant temperature effect and avoids the problem of burning down the heating cable 5. The heating device therefore has a longer operational life span.

Figure 7:
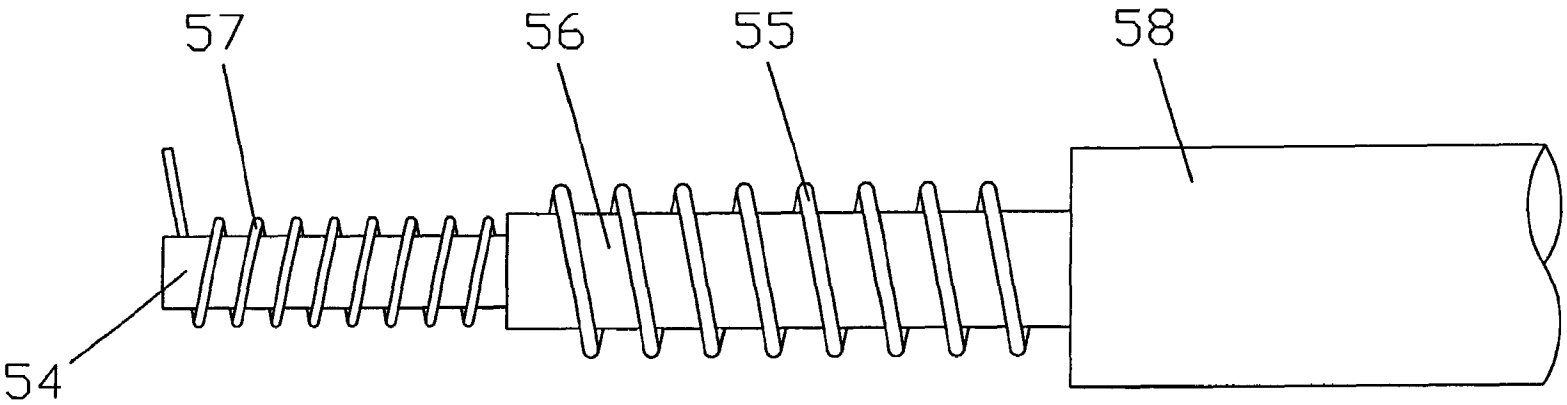
FIG. 7 is a schematic diagram showing a second embodiment the heating cable of FIG. 1.

As shown in FIG. 7, another embodiment of the heating cable 5 has the PTC heating wire 57 winding spirally around the core 54 and the heating wire 55 winding around the NTC layer 56.

Figure 8:
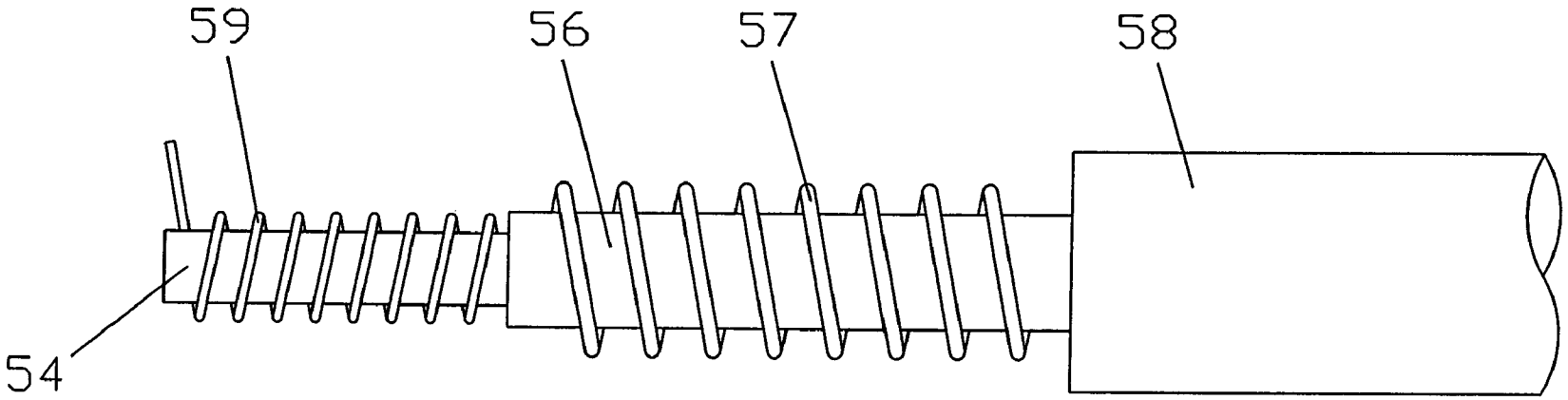
FIG. 8 is a schematic diagram showing a third embodiment the heating cable of FIG. 1.

As shown in FIG. 8, yet another embodiment of the heating cable 5 has another PTC heating wire 59 winding spirally around the core 54 and the PTC heating wire 57 winding around the NTC layer 56.

Figure 9:
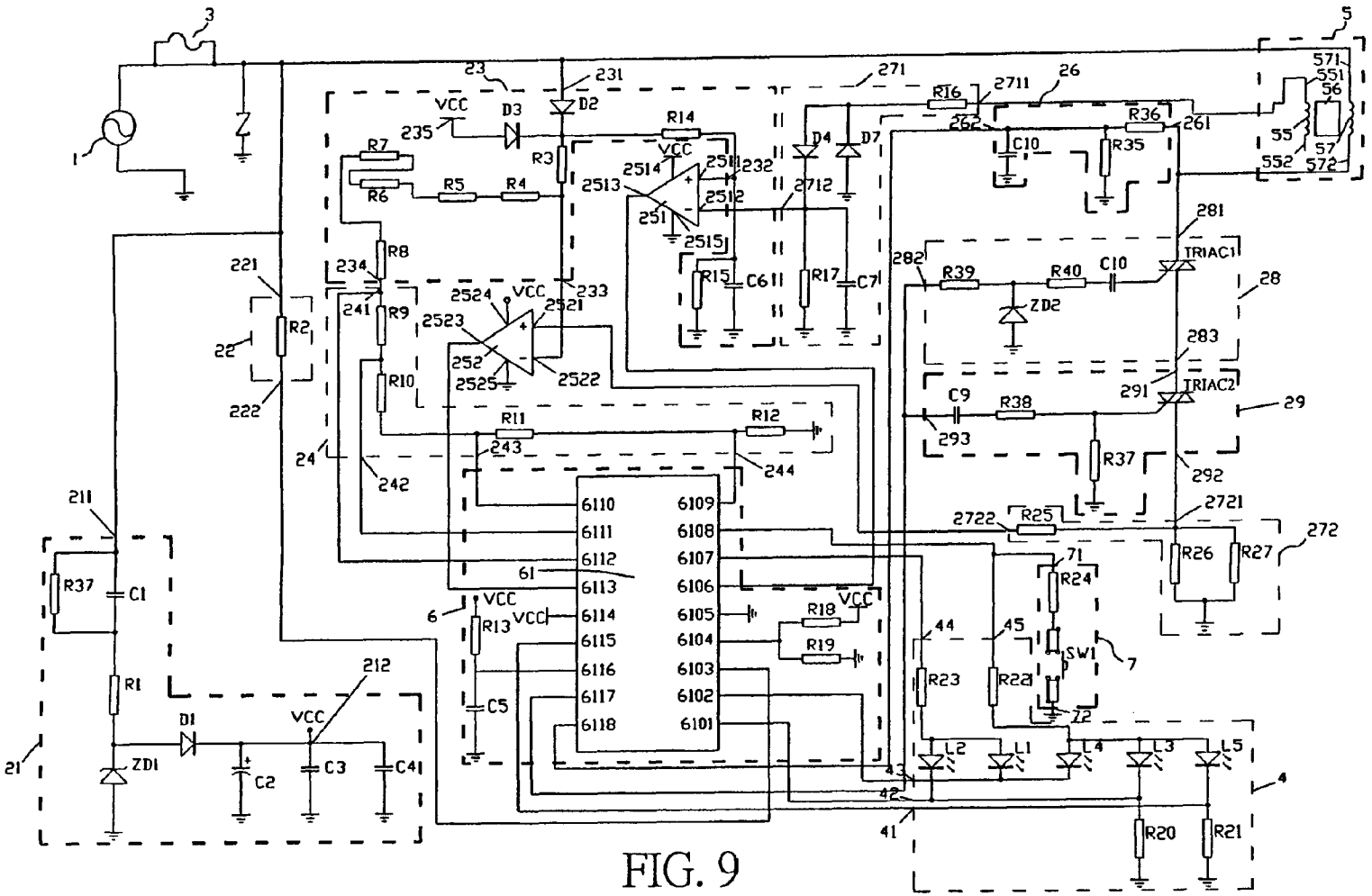
FIG. 9 is a circuit diagram showing a second embodiment of the heating device of FIG. 1.

FIG. 9 shows another embodiment of the heating device, whose protection circuit 28 and the switch circuit 29 are different from those of the previous embodiment. As illustrated, inside the protection circuit 28, a first triac TRIAC1 has the first and second anodes connected to the terminals 281 and 283, respectively. The gate of TRIAC1 is connected to the terminal 282 via a capacitor C10 and resistors R40 and R39, series-connected in this order. A second Zener diode ZD2 has its anode and cathode connected to the ground and the junction between the resistors R40 and R39, respectively In the present embodiment, the terminal 282 is connected to the terminal 6117 of the microcontroller 61.

Inside the switch circuit 29, a second triac TRIAC2 has the first and second anodes connected to the terminals 291 and 292, respectively. The gate of TRIAC2 is connected to the terminal 293 via a resistor R38 and a capacitor C9, series-connected in this order, and to the ground via a resistor R37.

Figure 10:
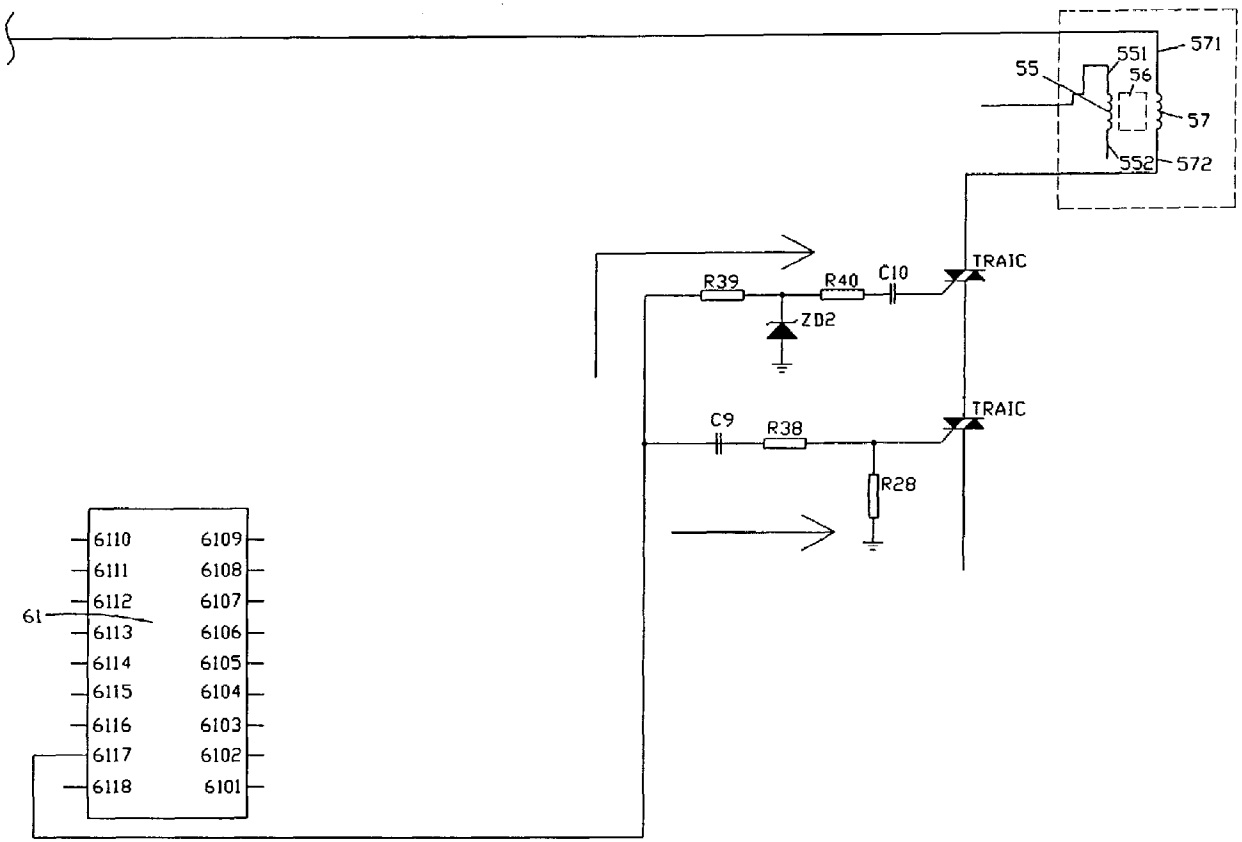
FIG. 10 is a partial circuit diagram showing the operation of the protection circuit and the switch circuit of FIG. 9.

As shown in FIG. 10, when a high voltage is produced at the terminal 6117 of the microcontroller 61, both triacs TRIAC1 and TRIAC2 are conducted. On the other hand, when a low voltage is produced at the terminal 6117 of the microcontroller 61, both triacs TRIAC1 and TRIAC2 are turned off. When one of the triacs is broken down, the other one could still function normally so as to maintain the normal operation of the heating cable 5.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A heating device, comprising a heating cable and a controller circuit; wherein said heating cable has a core and said core is wound spirally by a heating wire; said core and said heating wire are clad in a NTC (negative-temperature-coefficient) layer which is wound spirally by a PTC (positive-temperature-coefficient) heating wire; said NTC layer and said PTC heating wire are clad in an insulating layer; a first end of said PTC heating wire is connected to an AC power source (1) via a fuse (3); said NTC layer transmits a leakage current from said PTC heating wire to said heating wire;

a DC voltage circuit has a first terminal connected to said AC power source via said fuse and produces a DC voltage Vcc at a second terminal of said DC voltage circuit;

said controller circuit comprises a microcontroller having terminals (6101 to 6118), whose terminals (6114 and 6105) are connected to said Vcc and ground, respectively;

a first comparator and a second comparator have their power terminals connected to said Vcc, their ground terminals connected to ground, and their output terminals to said terminals (6106 and 6113) of said microcontroller, respectively;

a synchronous signal input circuit has a first terminal and a second terminal connected to said AC power source via said fuse and said terminal (6103) of said microcontroller, respectively;

a reference voltage circuit has a first terminal connected to said AC power source via said fuse, a second terminal connected to a positive terminal of said first comparator, a third terminal connected to a negative terminal of said second comparator, a fourth terminal connected to said terminal (6112) of said microcontroller, and a power terminal connected to said Vcc;

an adjustment circuit has a first terminal connected to said terminal (6112) of said microcontroller, and a second terminal, a third terminal, a fourth terminal connected to said terminals (6111, 6110, and 6109) of said microcontroller, respectively;

a NTC detection circuit has a first terminal connected to at least an end of said heating wire to receive said leakage current, a second terminal connected to a negative terminal of said first comparator;

a PTC detection circuit has a second terminal connected to a positive terminal of said second comparator;

a switch circuit has a second terminal connected to a first terminal of said PTC detection circuit, and a third terminal connected to said terminal (6117) of said microcontroller;

a load detection circuit has a first terminal connected to the other end of said PTC heating wire, and a second terminal connected to said terminal (6118) of said microcontroller;

a protection circuit has a power terminal connected to said Vcc, a first terminal connected to the other end of said PTC heating wire, a second terminal connected to said AC power source via said fuse, and a third terminal connected to a first terminal of said switch circuit; and a function selection circuit has a first terminal connected to said terminal (6108) of said microcontroller, and a second terminal connected to ground.

2. The heating device according to claim 1, wherein said adjustment circuit comprises resistors (R9, R10, R11, and R12), series-connected in this order between said first terminal and ground; and said second, third, and fourth terminals are connected to the junctions between said resistors (R9 and R10, R10 and R11, and R11 and R12), respectively.

3. The heating device according to claim 1, wherein said NTC detection circuit comprises a resistor (R16) and a diode (D7) series-connected in this order between said first terminal of said NTC detection circuit and ground with said diode's (D7) anode connected to ground, a resistor (R17) and a capacitor (C7) parallel-connected between said second terminal of said NTC detection circuit and ground; and said second terminal of said NTC detection circuit is further connected to the junction between said resistor (R16) and said diode (D7) via a diode (D4) whose cathode is connected to said second terminal of said NTC detection circuit.

4. The heating device according to claim 1, wherein said PTC detection circuit comprises resistors (R26 and R27) parallel-connected between said first terminal of said PTC detection circuit and ground, and a resistor (R25) between said first and second terminals of said PTC detection circuit.

5. The heating device according to claim 1, wherein said switch circuit has a thyristor (T2) whose anode and cathode are connected to said first and second terminals of said switch circuit, respectively, and whose gate is connected to said third terminal of said switch circuit and to ground via resistors (R29 and R28), respectively.

6. The heating device according to claim 1, wherein said load detection circuit comprises a capacitor (C10) and a resistor (R35), parallel-connected together between said second terminal of said load detection circuit and ground, and a resistor (R36) between said first and second terminals of said load detection circuit.

7. The heating device according to claim 1, wherein, inside said protection circuit, said first terminal of said protection circuit is connected the anode of a thyristor (T1) whose cathode is connected to said third terminal of said protection circuit; said thyristor thyristor's (T1) gate is connected to the emitter of a transistor (Q1) via a resistor (R33), said third terminal is also connected to said second terminal of said protection circuit via a resistor (R34), said power terminal of said protection circuit is, on one hand, connected to the collector (C) of said transistor (Q1) and, on the other hand, connected to the cathode of a diode (D5) and a terminal of a capacitor (C8), the other terminal of said capacitor (C8) and the anode of said diode (D5) are connected to the base of said transistor (Q1) via a resistor (R32) and to said third terminal of said protection circuit via a diode (D6) and a resistor (R30)

series-connected in this order with the diode's (D6) anode connected to said resistor (R30), and to ground via a resistor (R31).

8. The heating device according to claim 1, wherein said first terminal of said NTC detection circuit is connected to a first end of said heating wire, a second end of said heating wire, or both.

9. The heating device according to claim 1, wherein, inside said protection circuit, a first triac TRIAC1 has the first and second anodes connected to said first and third terminals of said protection circuit, respectively; the gate of said TRIAC1 is connected to said second terminal of said protection circuit via a capacitor C10 and resistors 9 (R40 and R39), series-connected in this order; and a second Zener diode (ZD2) has its anode and cathode connected to ground and the junction between said resistors (R40 and R39), respectively.

10. The heating device according to claim 1, wherein, inside said switch circuit, a second triac (TRIAC2) has the first and second anodes connected to said first and second terminals of said switch circuit, respectively; and the gate of said (TRIAC2) is connected to said third terminal via a resistor (R38) and a capacitor (C9), series-connected in this order, and to ground via a resistor (R37).

* * * * *